US007712478B2

(12) United States Patent
Gibbons et al.

(10) Patent No.: US 7,712,478 B2
(45) Date of Patent: May 11, 2010

(54) ERGONOMIC CRUTCH

(75) Inventors: Clay Gibbons, Worland, WY (US); Stephen Sanford, Bozeman, MT (US); David Yakos, Bozeman, MT (US)

(73) Assignee: CowboyLogic, LLC, Worland, WY (US)

( * ) Notice: Subject to any disclaimer, the term of this patent is extended or adjusted under 35 U.S.C. 154(b) by 18 days.

(21) Appl. No.: 12/098,515

(22) Filed: Apr. 7, 2008

(65) Prior Publication Data

US 2009/0250088 A1 Oct. 8, 2009

(51) Int. Cl.
*A61H 3/02* (2006.01)
*A45B 3/00* (2006.01)

(52) U.S. Cl. ..... 135/73; 135/66; 135/72; 135/75; 135/82; 248/188.5; 248/188.9

(58) Field of Classification Search ..... 135/65–66, 135/68, 71–73, 75–76, 82, 84; 248/188.5, 248/188.9; 403/109.1–109.3; 482/76; 297/411.1–411.2
See application file for complete search history.

(56) References Cited

U.S. PATENT DOCUMENTS

| | | | | | |
|---|---|---|---|---|---|
| 562,333 | A | | 6/1896 | Lund | |
| 1,183,008 | A | | 5/1916 | Hipwood | |
| 1,266,074 | A | | 5/1918 | Sparrow | |
| 1,495,865 | A | * | 5/1924 | Moore | 135/68 |
| 2,429,409 | A | * | 10/1947 | Eidman | 135/72 |
| 2,552,902 | A | * | 5/1951 | Miley et al. | 135/73 |
| 2,696,826 | A | | 12/1954 | Davies | |
| 2,707,478 | A | | 5/1955 | Davies | |
| 3,335,735 | A | * | 8/1967 | Colegrove et al. | 135/69 |
| 3,768,495 | A | * | 10/1973 | Smith | 135/72 |
| 4,151,853 | A | * | 5/1979 | Inbar | 135/71 |
| 4,917,126 | A | | 4/1990 | Ellmore | |
| 5,139,040 | A | | 8/1992 | Kelly | |
| 5,353,825 | A | | 10/1994 | Davis | |
| 5,409,029 | A | | 4/1995 | Davis | |
| 5,482,071 | A | * | 1/1996 | Liu | 135/66 |
| 5,628,335 | A | * | 5/1997 | Free | 135/68 |
| 5,647,519 | A | | 7/1997 | Brennan | |
| 5,725,005 | A | | 3/1998 | Yamasaki | |
| 5,771,910 | A | | 6/1998 | Kluttz | |
| 5,865,180 | A | | 2/1999 | Sigfrid | |
| 6,055,998 | A | | 5/2000 | Bader | |
| 6,164,305 | A | | 12/2000 | Herman | |
| 6,280,072 | B1 | * | 8/2001 | Poston | 366/1 |
| 6,378,541 | B1 | | 4/2002 | Matthews | |
| 6,439,088 | B1 | * | 8/2002 | Eytchison et al. | 83/13 |
| 6,851,438 | B2 | | 2/2005 | Battiston | |
| 7,104,271 | B2 | | 9/2006 | Larson et al. | |
| 7,204,262 | B2 | | 4/2007 | Demay et al. | |

(Continued)

FOREIGN PATENT DOCUMENTS

JP 06086793 A * 3/1994

(Continued)

*Primary Examiner*—Winnie Yip
(74) *Attorney, Agent, or Firm*—Antoinette M. Tease

(57) ABSTRACT

An ergonomic crutch comprising an armpit pad assembly, a top tube, a middle tube, a bottom tube, a hand grip, a shock absorber, and a footpad assembly. The armpit pad assembly comprises an armpit pad and means for allowing the armpit pad to tilt vertically and swivel horizontally. In an alternate embodiment, the crutch does not have a shock absorber.

30 Claims, 13 Drawing Sheets

U.S. PATENT DOCUMENTS

2001/0027802 A1 10/2001 McGrath
2002/0144723 A1* 10/2002 Zulla et al. ..... 135/71
2003/0106576 A1 6/2003 Tunnell, Jr. et al.
2004/0025926 A1 2/2004 Gin et al.
2004/0035453 A1 2/2004 McGrath
2006/0000499 A1* 1/2006 Livacich et al. ..... 135/90
2007/0006906 A1 1/2007 Coe
2007/0089770 A1 4/2007 Park
2008/0163914 A1* 7/2008 Weber et al. ..... 135/68

FOREIGN PATENT DOCUMENTS

JP 2003153767 A * 5/2003

* cited by examiner

ERGONOMIC CRUTCH

BACKGROUND OF THE INVENTION

1. Field of the Invention

The present invention relates generally to the field of medical devices, and more specifically, to an ergonomic crutch.

2. Description of the Related Art

Traditional crutches have stationary armpit pads, a hand grip that is vertically aligned with the armpit pad, and no way of adjusting the angle of the hand grip relative to the armpit pad. In an attempt to make crutches more ergonomic, shock absorbers have been incorporated into crutches to generate a more horizontal plane of travel (as opposed to an arc) of the armpit pad when the crutch is in use. Some prior art designs for crutches have incorporated a vertical tilt to the armpit pad itself to provide for a more comfortable fit between the patient's underarm and the armpit pad of the crutch.

In some crutches currently available on the market, the hand grip has been moved from its traditional location inside of the crutch frame to a position outside of the crutch frame and further away from the body. Various accessories, such as crutch pockets and pouch bags, have been added to crutches to make it more convenient for the patient to carry items while using crutches. All of these innovations in crutch design are intended to make crutches easier and more comfortable to use.

None of these prior art crutch designs, however, has solved the particular problem that is addressed by the present invention, and that is, that the angle of a person's palm in relation to the rest of his or her body when the person's arm is allowed to hang freely varies from individual to individual. This problem is solved in the present invention by allowing the armpit pad to swivel horizontally so that the patient can achieve the most comfortable position of the hand grip in relation to the armpit pad.

The present invention also offers the advantage of being collapsible into three pieces, which can be held together with a strap and carried in a stuff bag for easy portability. These and other advantages of the present invention are discussed more fully below.

BRIEF SUMMARY OF THE INVENTION

The present invention is an ergonomic crutch comprising an armpit pad assembly; a top tube; a middle tube; a bottom tube; a hand grip; a shock absorber; and a footpad assembly; the armpit pad assembly comprises an armpit pad and means for allowing the armpit pad to tilt vertically and swivel horizontally; the top tube comprises a top end and a bottom end, and the armpit pad assembly connects to the top end of the top tube; the middle tube comprises a top end and a bottom end; the bottom end of the top tube slides into the top end of the middle tube; the bottom tube comprises a top end and a bottom end; the top end of the bottom tube slides into the bottom end of the middle tube; the hand grip is offset laterally from the middle tube; the shock absorber comprises a barrel and a piston; the barrel of the shock absorber is situated inside of the bottom end of the bottom tube, and the piston of the shock absorber protrudes downward from the bottom end of the bottom tube; the footpad assembly comprises a footpad; the piston of the shock absorber comprises a top end and a bottom end; and the bottom end of the piston of the shock absorber connects to the footpad. In a preferred embodiment, the top, middle and bottom tubes are approximately the same length. Preferably, the armpit pad is gel-filled.

In a preferred embodiment, the middle tube comprises a top half and a bottom half; the middle tube comprises four series of spirally aligned apertures, two of which are located in the top half of the middle tube, and two of which are located in the bottom half of the middle tube; and the spirally aligned apertures are configured such that each aperture has a corresponding aperture exactly horizontal to it on an opposite side of the middle tube to facilitate securing the top and bottom tubes inside of the middle tube.

In a preferred embodiment, the hand grip comprises a cushioned pad and a metal bar; the middle tube comprises a middle; the metal bar is attached to the middle of the middle tube; the metal bar extends from the middle tube in one direction, makes a U turn, and then extends in an opposite direction to a point beyond the middle tube, thereby forming a short arm and a long arm of the metal bar; the cushioned pad is wrapped around the long arm of the metal bar; the cushioned pad comprises a center; the foot pad comprises a center; and the center of the cushioned pad is directly adjacent to the center of the foot pad from the perspective of a top view of the crutch. Preferably, the cushioned pad is gel-filled.

In a preferred embodiment, the present invention further comprises a rubber strap; the rubber strap is used to secure the top, middle and bottom tubes together when the crutch is disassembled; the rubber strap comprises a first end and a second end; the first end of the rubber strap is attached to the middle tube at a point directly beneath the point at which the metal bar of the hand grip is attached to the middle of the middle tube; there is a side of the middle tube that faces the patient when the crutch is in use and a side of the middle tube that does not face the patient when the crutch is in use; and the point at which the rubber strap is attached to the middle tube is on the side of the middle tube that faces the patient when the crutch is in use.

In a preferred embodiment, the present invention further comprises a clipboard, and the clipboard attaches to the middle tube at a point on the middle tube directly opposite the point at which the rubber strap attaches to the middle tube. Preferably, the clipboard comprises a magnetic strip.

In a preferred embodiment, the present invention further comprises a removable beverage holder; the beverage holder comprises a top end and a bottom end; the top end of the beverage holder attaches to the middle tube at a point on the middle tube directly opposite the point at which the rubber strap attaches to the middle tube; and the bottom end of the beverage holder is not attached to the middle tube so that it can swing freely and maintain a vertical orientation when the crutch is in use.

In a preferred embodiment, the crutch is used by a patient, and the shock absorber is adjustable based on the weight of the patient. Preferably, the footpad comprises a broad rounded underside that allows the foot pad to rock in all directions.

In a preferred embodiment, the armpit pad assembly further comprises a primary swivel part, a first washer, a cap, a second washer, a nut, and a shoulder bolt; the armpit pad comprises an underside; the primary swivel part is inserted into the underside of the armpit pad and secured with the shoulder bolt; the primary swivel part comprises a top section, a disc, a bottom extension, and a threaded portion; the shoulder bolt extends through an aperture in the top section of the primary swivel part; the cap comprises a top surface with an aperture and an underside; the first washer is positioned over the bottom extension of the primary swivel part and the bottom extension inserted into the aperture in the top surface of the cap; the second washer is inserted over the bottom extension of the primary swivel part underneath the aperture in the top surface of the cap; the nut is screwed onto the threaded portion of the primary swivel part to secure the primary swivel part on the cap; the cap is affixed to the top end of the top tube; and the disc of the primary swivel part lies flat against the first washer, the first washer lies flat against the top surface of the cap, and the second washer lies flat against the underside of the top surface of the cap, thereby allowing the armpit pad to swivel horizontally in relation to the top tube.

In a preferred embodiment, the disc of the primary swivel part comprises a bottom surface; the primary swivel part comprises a bottom extension that extends downward from the bottom surface of the disc and connects to the threaded portion of the primary swivel part; the bottom extension has a height; the first washer, top surface of the cap, and second washer each has a thickness; and the height of the bottom extension is slightly greater than the total thickness of the first washer, the top surface of the cap, and the second washer.

In a preferred embodiment, the underside of the armpit pad comprises two angled walls and two shoulders; the top section of the primary swivel part fits in between the two shoulders of the armpit pad; the shoulder bolt extends through an aperture on one side of the armpit pad, through one of the two shoulders, through the aperture in the top section of the primary swivel part, and through the other shoulder; and the shoulder bolt comprises a threaded portion that screws into a side wall of the armpit pad.

In a preferred embodiment, the angled walls of the armpit pad allow the armpit pad to tilt vertically when the armpit pad assembly is fully assembled; each angled wall has an angle, and the angle of one angled wall is equal to the angle of the other angled wall; the angle of the angled walls determines how far the armpit pad is capable of tilting vertically; and the angle of the angled walls can be adjusted during manufacture to allow for greater or lesser tilt of the armpit pad.

In an alternate embodiment, the present invention is an ergonomic crutch comprising an armpit pad assembly; a top tube; a middle tube; a bottom tube; a hand grip; and a footpad assembly; the armpit pad assembly comprises an armpit pad and means for allowing the armpit pad to tilt vertically and swivel horizontally; the top tube comprises a top end and a bottom end, and the armpit pad assembly connects to the top end of the top tube; the middle tube comprises a top end and a bottom end; the bottom end of the top tube slides into the top end of the middle tube; the bottom tube comprises a top end and a bottom end; the top end of the bottom tube slides into the bottom end of the middle tube; and the hand grip is offset laterally from the middle tube. Preferably, the armpit pad is gel-filled.

In a preferred embodiment, the middle tube comprises a top half and a bottom half; the middle tube comprises four series of spirally aligned apertures, two of which are located in the top half of the middle tube, and two of which are located in the bottom half of the middle tube; and the spirally aligned apertures are configured such that each aperture has a corresponding aperture exactly horizontal to it on an opposite side of the middle tube to facilitate securing the top and bottom tubes inside of the middle tube.

In a preferred embodiment, the hand grip comprises a cushioned pad and a metal bar; the middle tube comprises a middle; the metal bar is attached to the middle of the middle tube; the metal bar extends from the middle tube in one direction, makes a U turn, and then extends in an opposite direction to a point beyond the middle tube, thereby forming a short arm and a long arm of the metal bar; the cushioned pad is wrapped around the long arm of the metal bar; the cushioned pad comprises a center; the foot pad comprises a center; and the center of the cushioned pad is directly adjacent to the center of the foot pad from the perspective of a top view of the crutch. Preferably, the cushioned pad is gel-filled.

In a preferred embodiment, the present invention further comprises a rubber strap; the rubber strap is used to secure the top, middle and bottom tubes together when the crutch is disassembled; the rubber strap comprises a first end and a second end; the first end of the rubber strap is attached to the middle tube at a point directly beneath the point at which the metal bar of the hand grip is attached to the middle of the middle tube; there is a side of the middle tube that faces the patient when the crutch is in use and a side of the middle tube that does not face the patient when the crutch is in use; and the point at which the rubber strap is attached to the middle tube is on the side of the middle tube that faces the patient when the crutch is in use.

In a preferred embodiment, the present invention further comprises a clipboard, and the clipboard attaches to the middle tube at a point on the middle tube directly opposite the point at which the rubber strap attaches to the middle tube. Preferably, the clipboard comprises a magnetic strip.

In a preferred embodiment, the present invention further comprises a removable beverage holder; the beverage holder comprises a top end and a bottom end; the top end of the beverage holder attaches to the middle tube at a point on the middle tube directly opposite the point at which the rubber strap attaches to the middle tube; and the bottom end of the beverage holder is not attached to the middle tube so that it can swing freely and maintain a vertical orientation when the crutch is in use.

Preferably, the footpad comprises a broad rounded underside that allows the foot pad to rock in all directions.

In a preferred embodiment, the armpit pad assembly further comprises a primary swivel part, a first washer, a cap, a second washer, a nut, and a shoulder bolt; the armpit pad comprises an underside; the primary swivel part is inserted into the underside of the armpit pad and secured with the shoulder bolt; the primary swivel part comprises a top section, a disc, a bottom extension, and a threaded portion; the shoulder bolt extends through an aperture in the top section of the primary swivel part; the cap comprises a top surface with an aperture and an underside; the first washer is positioned over the bottom extension of the primary swivel part and the bottom extension inserted into the aperture in the top surface of the cap; the second washer is inserted over the bottom extension of the primary swivel part underneath the aperture in the top surface of the cap; the nut is screwed onto the threaded portion of the primary swivel part to secure the primary swivel part on the cap; the cap is affixed to the top end of the top tube; and the disc of the primary swivel part lies flat against the first washer, the first washer lies flat against the top surface of the cap, and the second washer lies flat against the underside of the top surface of the cap, thereby allowing the armpit pad to swivel horizontally in relation to the top tube.

In a preferred embodiment, the disc of the primary swivel part comprises a bottom surface; the primary swivel part comprises a bottom extension that extends downward from the bottom surface of the disc and connects to the threaded portion of the primary swivel part; the bottom extension has a height; the first washer, top surface of the cap, and second washer each has a thickness; and the height of the bottom extension is slightly greater than the total thickness of the first washer, the top surface of the cap, and the second washer.

In a preferred embodiment, the underside of the armpit pad comprises two angled walls and two shoulders; the top section of the primary swivel part fits in between the two shoulders of the armpit pad; the shoulder bolt extends through an aperture on one side of the armpit pad, through one of the two shoulders, through the aperture in the top section of the primary swivel part, and through the other shoulder; and the shoulder bolt comprises a threaded portion that screws into a side wall of the armpit pad.

In a preferred embodiment, the angled walls of the armpit pad allow the armpit pad to tilt vertically when the armpit pad assembly is fully assembled; each angled wall has an angle, and the angle of one angled wall is equal to the angle of the other angled wall; the angle of the angled walls determines how far the armpit pad is capable of tilting vertically; and the angle of the angled walls can be adjusted during manufacture to allow for greater or lesser tilt of the armpit pad.

| REFERENCE NUMBERS | |
|---|---|
| 1 | Armpit pad |
| 2 | Top tube |
| 3 | Middle tube |

-continued

| REFERENCE NUMBERS | |
|---|---|
| 4 | Bottom tube |
| 5 | Hand grip |
| 6 | Foot pad |
| 7 | Shock absorber |
| 8 | Cushioned pad |
| 9 | Metal tube (of hand grip) |
| 10 | Spirally aligned apertures (on middle tube) |
| 11 | Spring pin |
| 12 | Adjustment knob (on shock absorber) |
| 13 | Piston (of shock absorber) |
| 14 | Barrel (of shock absorber) |
| 15 | Rubber strap |
| 16 | Clipboard |
| 17 | Beverage holder |
| 18 | Armpit pad assembly |
| 19 | Nut |
| 20 | Bolt |
| 21 | Foot pad assembly |
| 22 | Knob (on spring pin) |
| 23 | Aperture (on top tube) |
| 24 | Knob (on rubber strap) |
| 25 | Apertures (in rubber strap) |
| 26 | Primary swivel part |
| 27 | First washer |
| 28 | Cap |
| 29 | Second washer |
| 30 | Nut |
| 31 | Shoulder bolt |
| 32 | Aperture (in top section of primary swivel part) |
| 33 | Threaded portion (of primary swivel part) |
| 34 | Aperture (in cap) |
| 35 | Disc (of primary swivel part) |
| 36 | Angled wall (of armpit pad) |
| 37 | Shoulder (of armpit pad) |
| 38 | Top section (of primary swivel part) |
| 39 | Threaded portion (of shoulder bolt) |
| 40 | Nut |
| 41 | Bolt |
| 42 | Extension (on barrel of shock absorber) |
| 43 | Aperture (in bottom tube) |
| 44 | Threaded recess (in foot pad) |
| 45 | End piece |
| 46 | Magnetic strip |
| 47 | Threaded extension (of end piece) |
| 48 | Aperture (in armpit pad) |
| 49 | Bottom extension (of primary swivel part) |

DETAILED DESCRIPTION OF INVENTION

Figure 1:
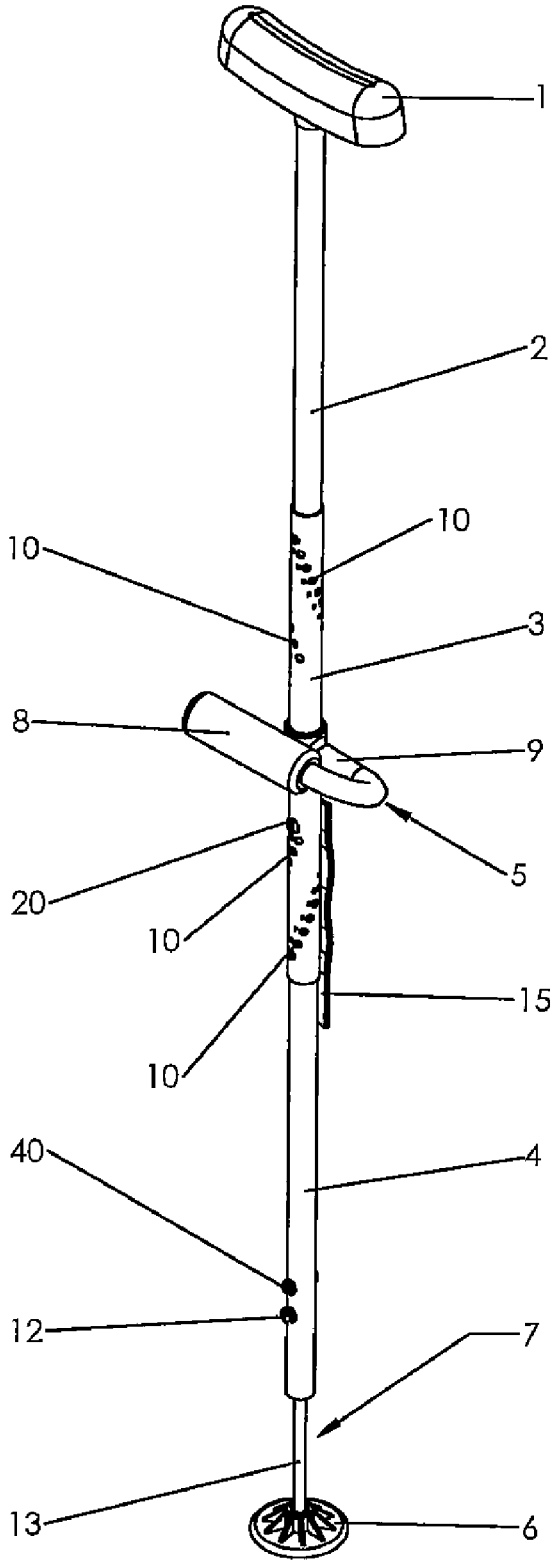
FIG. 1 is a perspective view of a first embodiment of the present invention.

FIG. 1 is a perspective view of a first embodiment of the present invention. As shown in this figure, the present invention is a crutch comprised of an armpit pad 1, a top tube 2, a middle tube 3, a bottom tube 4, a hand grip 5 and a foot pad 6. In this embodiment, the crutch further comprises a shock absorber 7. The armpit pad 1 is preferably gel-filled and ergonomically shaped so as to keep pressure off of the sensitive nerve areas of the armpit. As shown in subsequent figures, the armpit pad 1 both tilts vertically and swivels horizontally.

The hand grip 5 is welded onto the middle tube 3 and preferably comprises a gel-filled cushioned pad 8 for ease of grip. The present invention is not limited to any particular type of cushioned pad; the cushioned pad could be made of rubber or foam, for example. The hand grip 5 further comprises a metal bar 9 that extends in one direction from the middle tube 3, makes a U turn, and then extends in an opposite direction to a point beyond the middle tube 3 (this is also shown more clearly in FIG. 2) so that the side of the U-shaped metal bar with the cushioned pad 8 is longer than the side without the cushioned pad. The cushioned pad 8 is preferably situated on the metal bar 9 so that the center of the cushioned pad 8 is directly adjacent to the center of the foot pad 6 from the perspective of a top view of the crutch (see FIGS. 9 and 10).

The middle tube 3 preferably comprises four series of spirally aligned apertures 10, two situated underneath the hand grip 5 on the middle tube 3 and two situated above the hand grip 5 on the middle tube 3. These apertures 10 are aligned spirally to avoid the weakness in the middle tube 3 that would result if they were vertically aligned, and also to provide greater flexibility in terms of positioning the top and bottom tubes 2, 4 inside of the middle tube 3 (see FIG. 2). In addition, each aperture has a corresponding aperture on the opposite (horizontal) side of the middle tube 3 so that the spring pin 11 can hold the two tubes (either the top and middle tubes or the middle and bottom tubes) together (see FIG. 3).

The shock absorber 7 absorbs some of the weight of the patient and allows the patient to maintain a horizontal plane at the level of the armpit pad 1 when using the crutch as compared to the arc-shaped path of travel of the armpit pad 1 on a crutch without a shock absorber 7. Combined with the vertically tilting armpit pad 1, the shock absorber 7 allows the armpit pad 1 to stay horizontal and in contact with the patient's armpit throughout the walking cycle. This results in a forward motion that is more fluid, level, and comfortable for the patient. It also allows the patient to rely more heavily on the armpit pad to carry her weight as opposed to the patient having to carry all of her weight with her arms.

Figure 11:
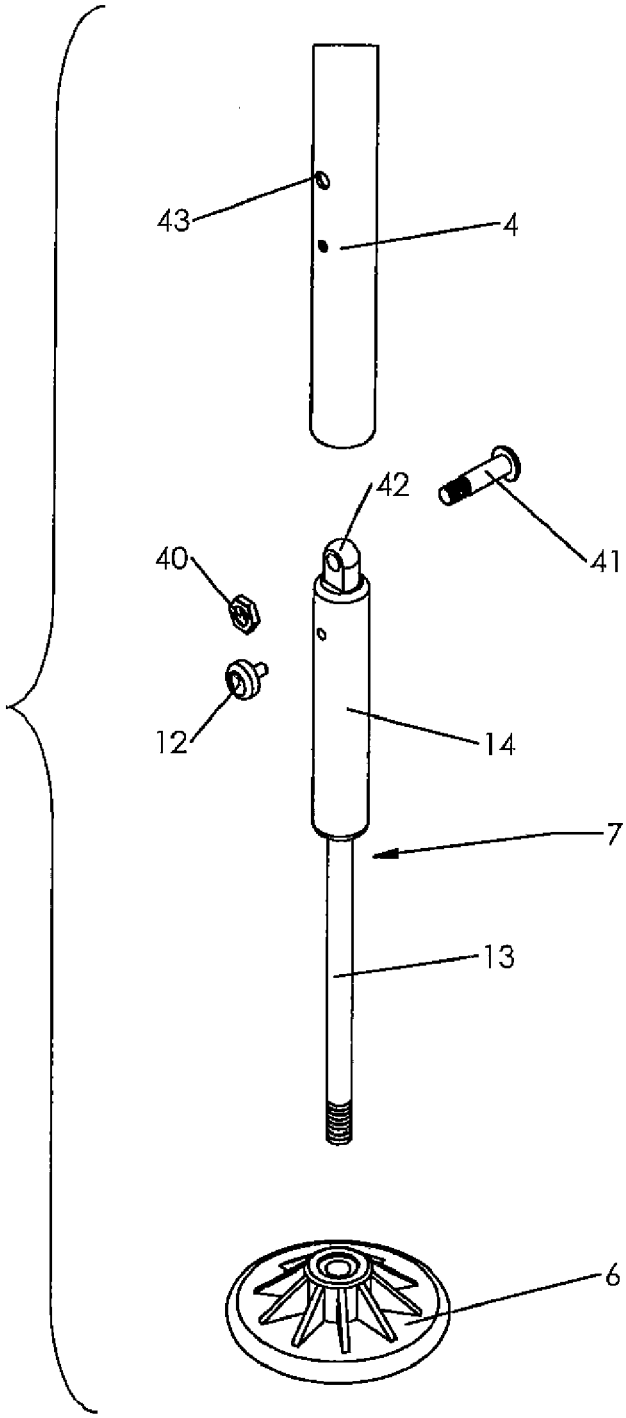
FIG. 11 is an exploded view of the footpad section of a first embodiment of the present invention.

The shock absorber 7 is designed to fit into the inner diameter of the bottom tube 4 and is fastened to the bottom tube 4 with a nut and bolt (see FIG. 11). The tension of the shock absorber 7 is preferably adjustable to accommodate the weight of the patient. The tension of the shock absorber is adjusted via an adjustment knob 12 that extends from the barrel 14 of the shock absorber 7 (see FIG. 11) through the bottom tube 4. Preferably, the two shock absorbers 7 together (one on the right-hand crutch and one on the left-hand crutch) can be adjusted to accommodate patients weighing from 80 to 300 pounds (i.e., each shock absorber 7 will handle between 40 and 150 pounds).

In a preferred embodiment, the piston 13 of the shock absorber 7 extends below the bottom tube 4 and has a stroke of approximately three inches. The diameter of the barrel 14 of the shock absorber 7 is slightly less than the inside diameter of the bottom tube 4.

Figure 2:
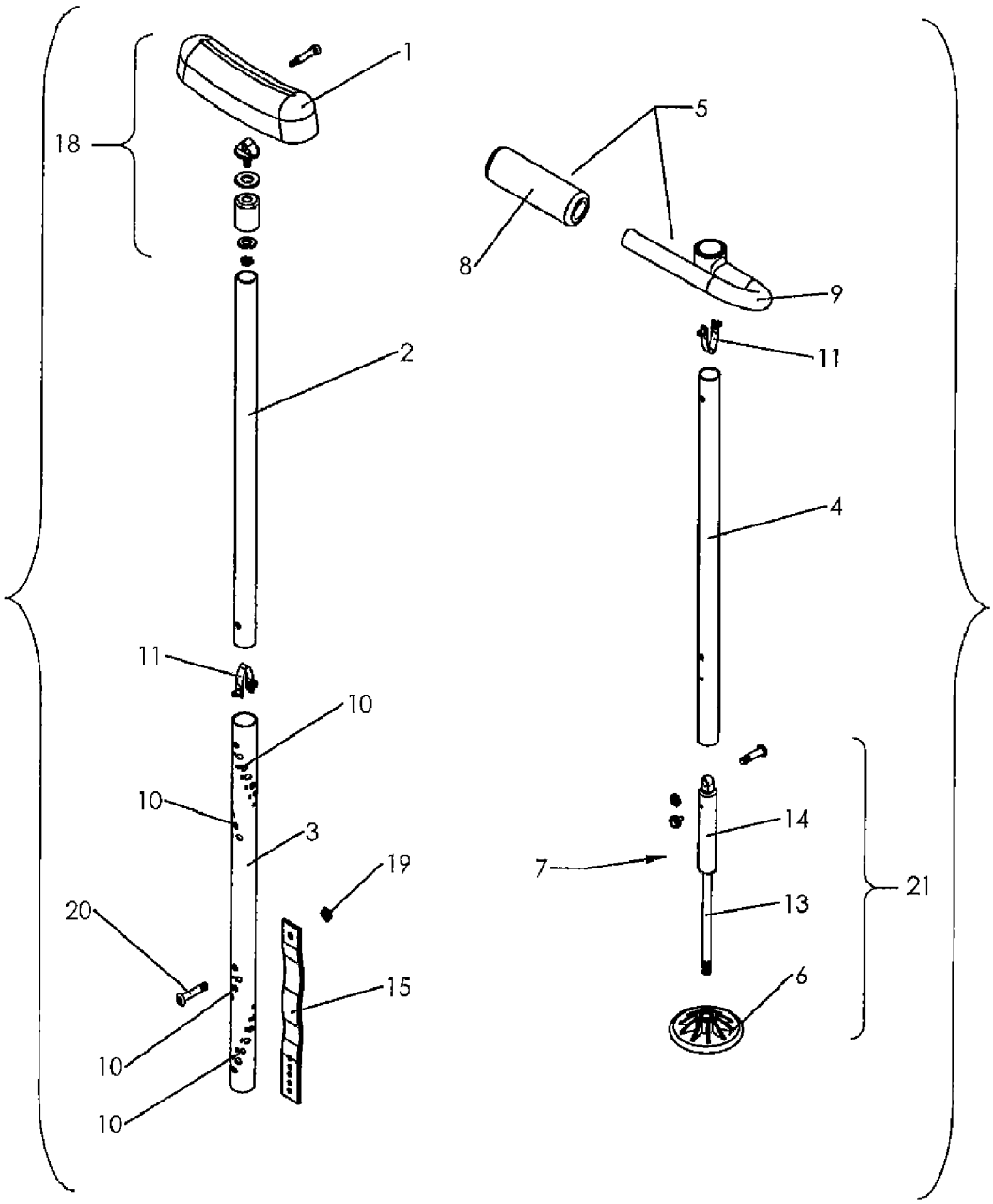
FIG. 2 is an exploded view of a first embodiment of the present invention.

As shown in FIG. 1, the present invention preferably comprises a rubber strap 15 that is attached to the middle tube 3 with a nut and bolt (see FIG. 2). Alternately, the rubber strap can be attached to the middle tube 3 with a rivet (not shown). The present invention is not limited to any particular method of attaching the rubber strap to the middle tube. The purpose of the rubber strap 15 is to hold the three tubes 2, 3, 4 together when they are disassembled for easy transport of the crutch. The rubber strap 15 is preferably attached to the middle tube 3 at a point directly underneath the hand grip (see FIG. 3A) on the inside of the crutch (i.e., the side of the crutch that is adjacent to the patient's body). The purpose of this positioning is so that the bolt (or rivet) that attaches the rubber strap 15 to the middle tube 3 can also be used to attach the clipboard 16 and beverage holder 17 to the middle tube 3 (see FIGS. 14 and 15).

Figure 16:
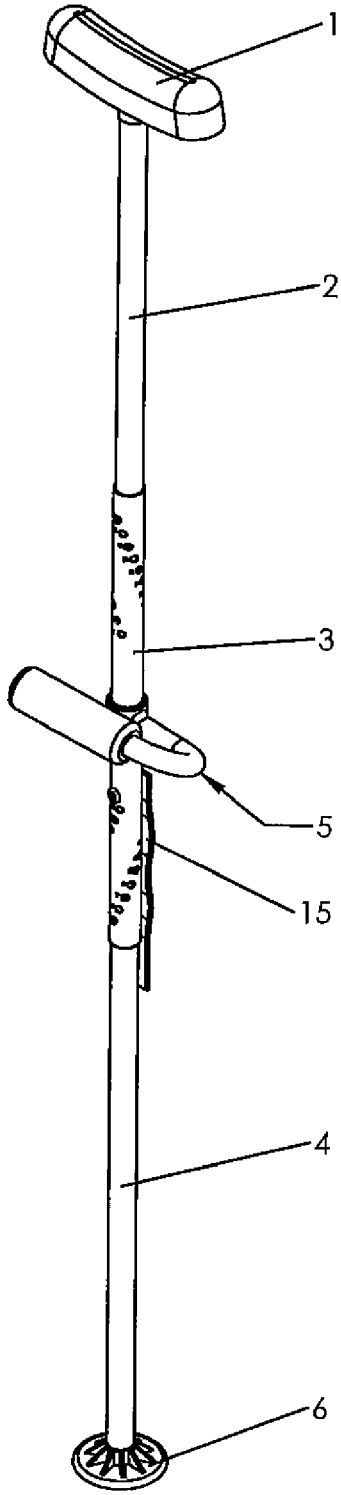
FIG. 16 is a perspective view of a second embodiment of the present invention.

The crutch shown in FIG. 1 and in FIG. 16 can be used on either the left-hand or the right-hand side of the patient. The present invention also covers the mirror image of the crutch shown in FIG. 1.

FIG. 2 is an exploded view of a first embodiment of the present invention. This figure shows the armpit pad assembly 18, which is shown in greater detail in FIG. 4. It also shows the spring pins 11 that hold the top tube 2 inside of the middle tube 3 and the bottom tube 4 inside of the middle tube 2. Also shown are the nut 19 and bolt 20 that hold the rubber strap 15 onto the middle tube 3 in one embodiment (in another embodiment the rubber strap is attached to the middle tube 3 with a rivet) and the foot pad/shock absorber assembly 21, which is shown in greater detail in FIG. 11.

As this figure illustrates, the top, middle and bottom tubes 2, 3, 4 are preferably approximately the same length. The outside diameter of the top and bottom tubes 2, 4 is slightly less than the inside diameter of the middle tube 3 so that the top and bottom tubes can slide into the middle tube for assembly of the crutch and out of the middle tube for disassembly and storage or transport.

Figure 3:
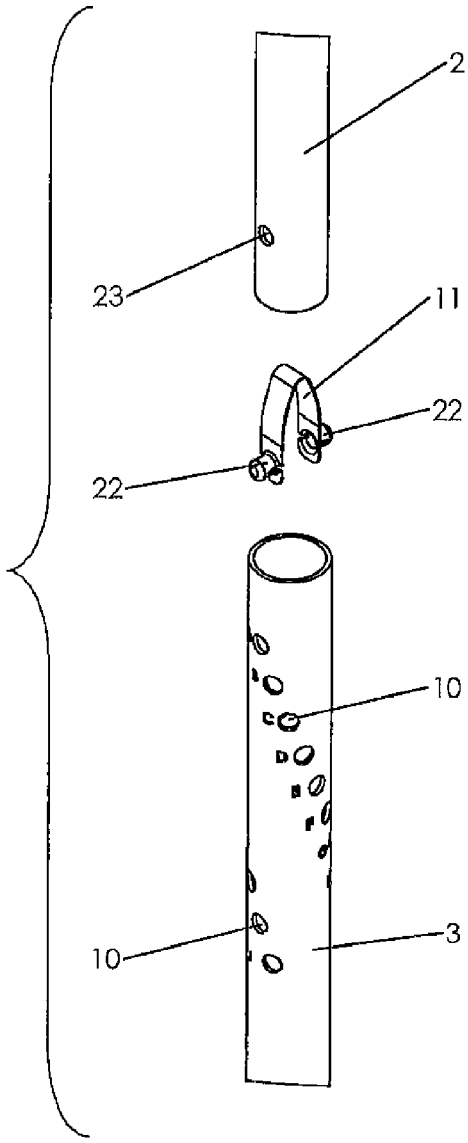
FIG. 3 is a detail view of the spring pin mechanism of the present invention.

FIG. 3 is a detail view of the spring pin mechanism of the present invention. The spring pin 11 is one mechanism of attaching the top and bottom tubes 2, 4 to the middle tube 3, but the present invention is not limited to any particular mechanism of attachment. In this embodiment, the spring pin 11 comprises two knobs 22. The spring pin 11 is inserted into the top tube 2 and the knobs 22 extended through two horizontally aligned apertures 23 (only one of which is visible in FIG. 3) directly opposite each other on the bottom end of the top tube 2. The spring pin 11 is then manually compressed so that the knobs 22 do not extend beyond the outer surface of the top tube 2, and the top tube 2 is inserted into the middle tube 3. The length of the crutch can be adjusted by moving the top tube 2 either farther down or farther up on the middle tube 3. To stabilize the top tube 2 in the middle tube 3, the spring pin 11 is decompressed (by lifting the pressure on the knobs 22), and the knobs 22 are allowed to extend through apertures 10 on the middle tube 3. The bottom tube 4 is inserted into the middle tube 3 in the same manner.

In a preferred embodiment, each spirally aligned series of apertures 10 (there are two on the top half of the middle tube 3 and two on the bottom half of the middle tube 3) is labeled either with numbers or letters (shown with letters in FIG. 3) so that, for example, the "A" in the first series of spirally aligned apertures 10 is horizontally aligned with the "A" on the second series of spirally aligned apertures. (The first and second series of spirally aligned apertures are both shown on the top half of the middle tube 3 in FIG. 3.) Similarly, on the bottom half of the middle tube 3, the number "1" in the third series of spirally aligned apertures 10 is horizontally aligned with the number "1" on the fourth series of spirally aligned apertures. In this manner, patients can refer to their preferred crutch length as "A1," B4, "C5," etc. In a preferred embodiment, each series of spirally aligned apertures 10 comprises ten individual apertures aligned in a spiral.

Figure 3A:
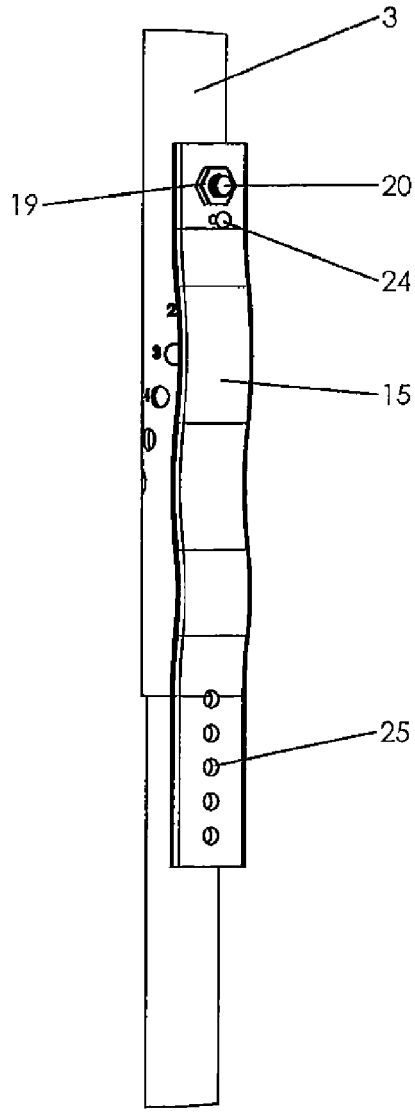
FIG. 3A is a detail view of the rubber strap attached to the middle tube of the present invention.

FIG. 3A is a detail view of the rubber strap attached to the middle tube of the present invention. As shown in this figure, the rubber strap 15 comprises a knob 24. To strap the three tubes 2, 3, 4 together, the crutch is disassembled, the tubes are held parallel to each other, and the rubber strap 15 is wrapped around the tubes. To secure the strap around the tubes, the knob 24 is inserted into and through one of the apertures 25 on the bottom end of the rubber strap 15. This is one way of securing the strap, but the present invention is not limited to this particular method. For example, a hook-and-loop-type fastener could be used as well.

Figure 4:
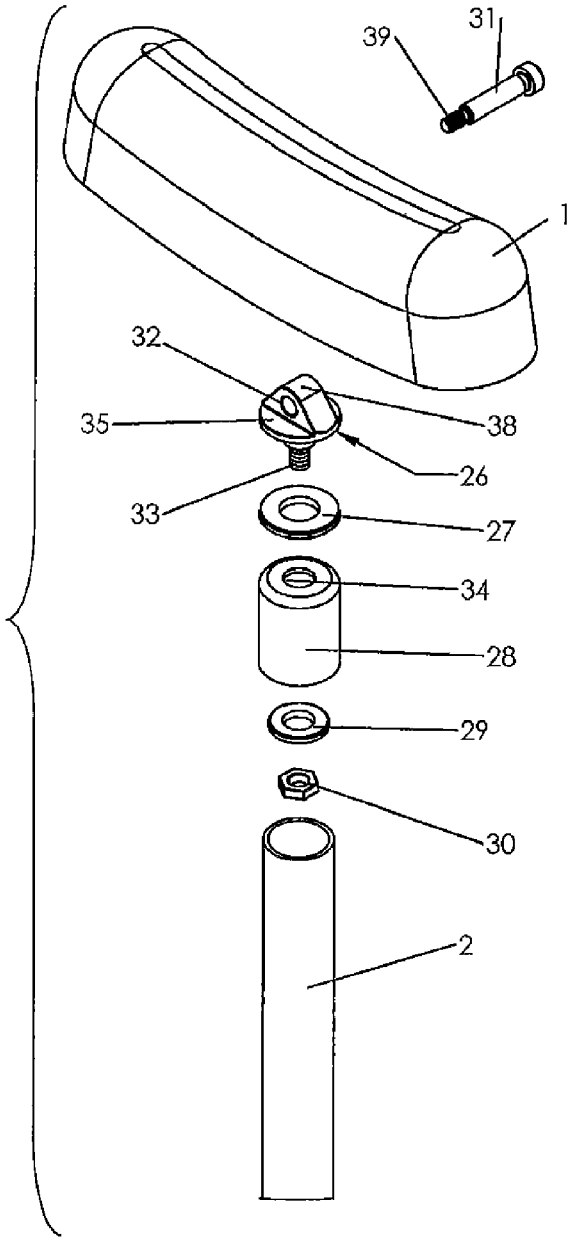
FIG. 4 is an exploded view of the armpit pad assembly of the present invention.

FIG. 4 is an exploded view of the armpit pad assembly of the present invention. The armpit pad assembly 18 comprises the armpit pad 1, the primary swivel part 26, a first washer 27, a cap 28, a second washer 29, and a nut 30. It also comprises a shoulder bolt 31. When the armpit pad assembly 1 is fully assembled, the primary swivel part 26 is inserted into the underside of the armpit pad 1 (see FIGS. 5-7) and secured with the shoulder bolt 31. The shoulder bolt 31 extends through an aperture 32 in the top section 3 8 of the primary swivel part 26. The first washer 27 is then positioned over the bottom extension 49 (see FIG. 4A) of the primary swivel part 26, and the bottom extension 49 is inserted into an aperture 34 in the cap 28. The second washer 29 is then inserted over the bottom extension 49 of the primary swivel part 26 underneath the aperture 34 in the cap 28, and the nut 30 is screwed onto the threaded portion 33 of the primary swivel part 26 to secure the primary swivel part on the cap 28. The cap 28 is then welded onto or slid over (without welding) the top of the top end of the top tube 2 (see FIG. 6). Although the armpit pad assembly 18 is shown with two washers, the present invention is not limited to any particular number of washers as long as one washer is on top of the top surface of the cap and another is on the underside of the top surface of the cap.

The primary swivel part 26 comprises a disc 35 that lies flat up against the first washer 27 when the armpit pad assembly 18 is assembled. The nut 30 is screwed tightly enough to hold the assembly in place but not so tight as to preclude the disc 35 from rotating on the first washer 27. Because the threaded portion 33 of the primary swivel part 26 is fixedly connected to the nut 30, the nut 30 rotates on the second washer 29 at the same time and to the same degree that the disc 35 of the primary swivel part 26 rotates on the first washer 27. The cap 28 is stationary during rotation of the primary swivel part 26 because it is fixedly attached (but not necessarily welded) to the top end of the top tube 2.

Figure 9:
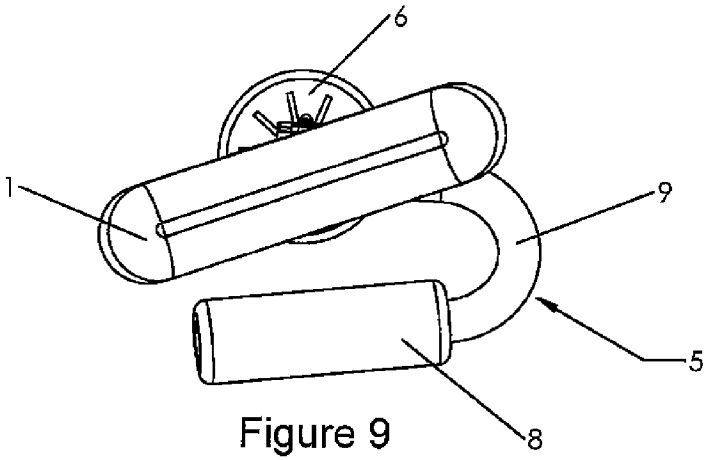
FIG. 9 is a top view of the present invention showing the armpit pad swiveled horizontally in a first direction.
Figure 10:
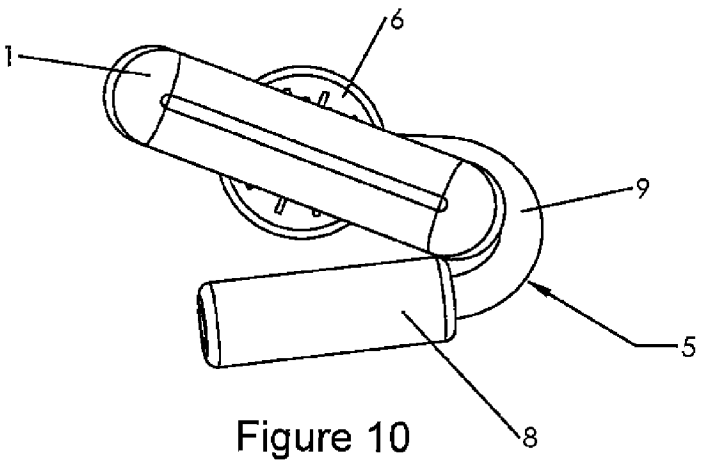
FIG. 10 is a top view of the present invention showing the armpit pad swiveled horizontally in a second direction.

Because of the primary swivel part 26 and the manner in which it is attached to the cap 28 and then armpit pad 1, the armpit pad 1 can swivel horizontally to accommodate the most comfortable position for the patient using the crutch. In particular, the horizontal swivel allows a patient to achieve the best angle of the hand grip 5 in relation to the armpit pad 1 for maximum comfort. This principle is illustrated in FIGS. 9 and 10.

Figure 4A:
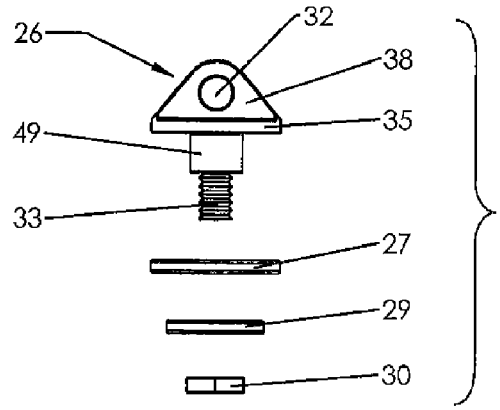
FIG. 4A is an exploded view of the primary swivel part, first washer, second washer and nut of the armpit pad assembly.
Figure 4B:
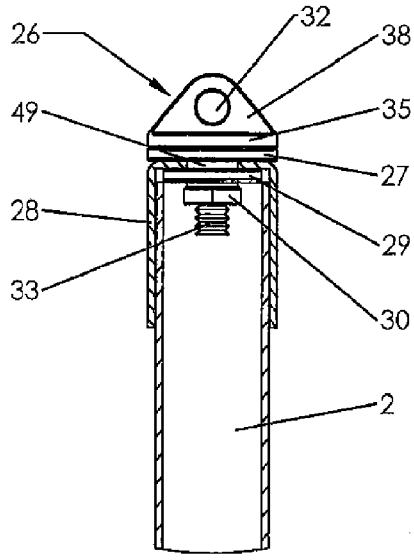
FIG. 4B is a side view of the primary swivel part, first washer, second washer and nut installed on the cap of the armpit pad assembly.

FIG. 4A is an exploded view of the primary swivel part, first washer, second washer and nut of the armpit pad assembly. As shown in this figure, the primary swivel part 26 comprises a bottom extension 49 that extends downward from the bottom surface of the disc 35 and connects to the threaded portion 33 of the primary swivel part 26. Preferably, the total height of the bottom extension (i.e., the distance from the bottom of the disc 35 to the top of the threaded portion 33) is slightly greater than the thickness of the first washer 27, the top of the cap 28, and the second washer 29 (see FIG. 4B).

Figure 5:
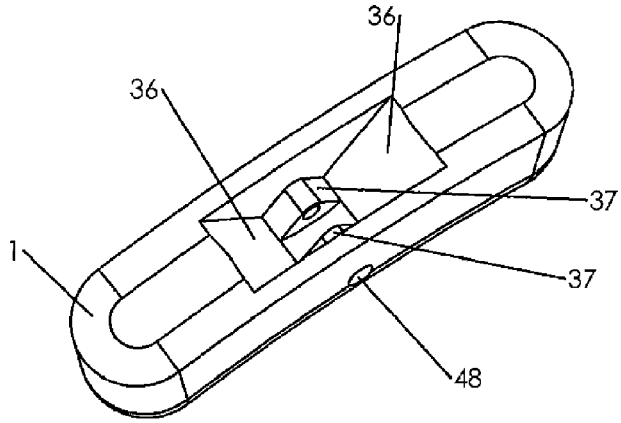
FIG. 5 is a bottom perspective view of the armpit pad of the present invention.
Figure 6:
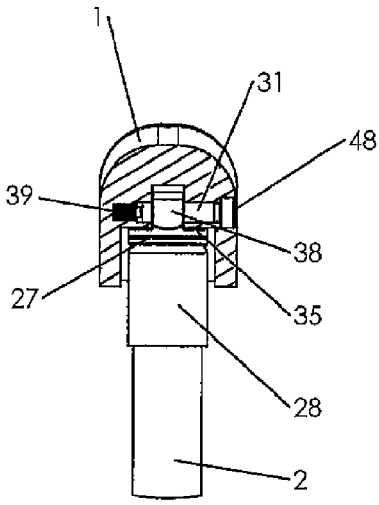
FIG. 6 is a first section view of the armpit pad assembly of the present invention.

FIG. 5 is a bottom perspective view of the armpit pad of the present invention. As shown in this figure, the underside of the armpit pad 1 preferably comprises two angled walls 36 and two shoulders 37. The top section 38 of the primary swivel part 26 fits securely in between the two shoulders 37 of the armpit pad 1, and the shoulder bolt 31 extends through an aperture 48 on the outside of the armpit pad 1, through one of the two shoulders 37, through the aperture 32 in the top section 38 of the primary swivel part 26, and through the other shoulder 37. The threaded portion 39 of the shoulder bolt 31 screws into the side wall (not to be confused with the "sloping wall" on the underside of the armpit pad) of the armpit pad 1 (see FIG. 6).

Figure 7:
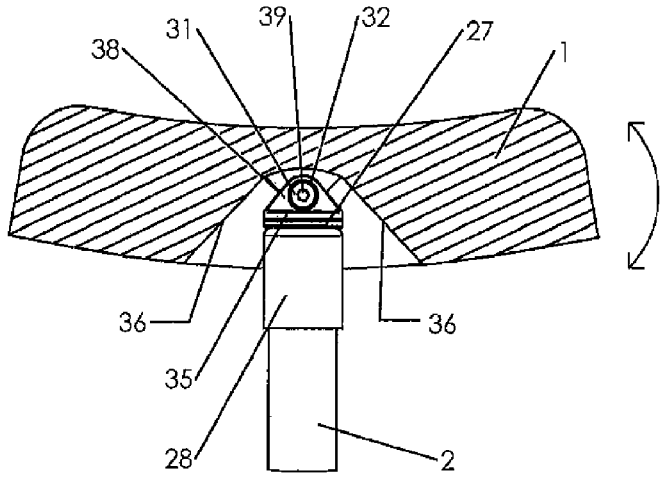
FIG. 7 is a second section view of the armpit pad assembly of the present invention.
Figure 8:
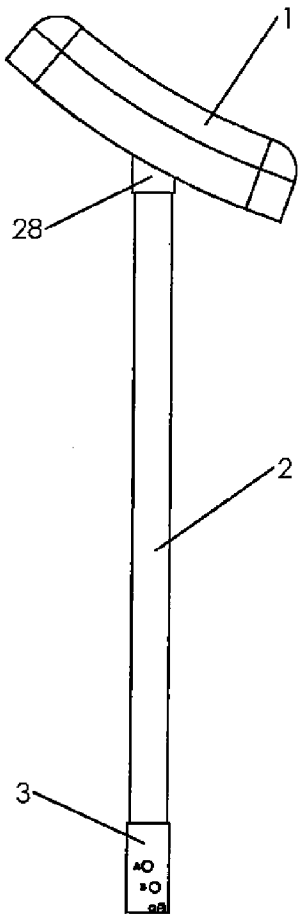
FIG. 8 is a partial side view of the present invention with the armpit pad tilted vertically.

The angled walls 36 of the armpit pad 1 allow the armpit pad to tilt vertically when the armpit pad assembly 18 is filly assembled (see FIGS. 7 and 8). The angle of the angled walls 36 determines the degree to which the armpit pad 1 will be capable of tilting before the cap 28 hits the angled wall 36, thereby preventing any further vertical tilt of the armpit pad 1. Referring to FIG. 7, a lesser angle to the angled walls (i.e., more gradually sloping walls) would allow the armpit pad 1 to tilt to a greater degree, whereas a greater angle to the angled walls (i.e., steeper walls) would restrict the degree to which the armpit pad 1 could tilt. In this manner, the present invention can be engineered so as to permit the desirable range of tilt of the armpit pad 1. The arrow on FIG. 7 indicates the direction of vertical tilt.

FIG. 8 is a partial side view of the present invention with the armpit pad tilted vertically. The mechanism that allows the armpit pad 1 to tilt vertically is described above in connection with FIGS. 4-7. The vertical tilt of the armpit pad 1 makes it easier for patients to get onto and off of the armpit pad 1 and maintains constant contact between the patient's armpit and the armpit pad 1 throughout the walking cycle.

FIG. 9 is a top view of the present invention showing the armpit pad swiveled horizontally in a first direction. FIG. 10 is a top view of the present invention showing the armpit pad swiveled horizontally in a second direction. As explained above, the purpose of the horizontal swivel is to allow the patient to achieve the most comfortable angle of the armpit pad 1 in relation to the hand grip 5, as shown in these two figures. These two figures also illustrate that the center of the cushioned pad 8 is preferably lined up with the center of the foot pad 6, as noted above.

FIG. 11 is an exploded view of the footpad section of a first embodiment of the present invention. As shown in this figure, the shock absorber 7 comprises a piston 13 and a barrel 14. An adjustment knob 12 on the barrel 14 allows the tension of the shock absorber to be adjusted to the weight of the patient. The outside diameter of the barrel 14 of the shock absorber 7 is slightly smaller than the inside diameter of the bottom tube 4 so that the barrel 14 can be inserted into the tube 4. The piston 13 extends downward from the base of the tube 4 (see FIG. 1) and screws into the foot pad 6. The barrel 14 is secured to the bottom tube 4 with a nut 40 and a bolt 41 that extends through an aperture (not shown) on one side of the bottom tube 4, through an extension 42 at the top of the barrel 14, and through an aperture 43 on the opposite side of the bottom tube 4.

Figure 13:
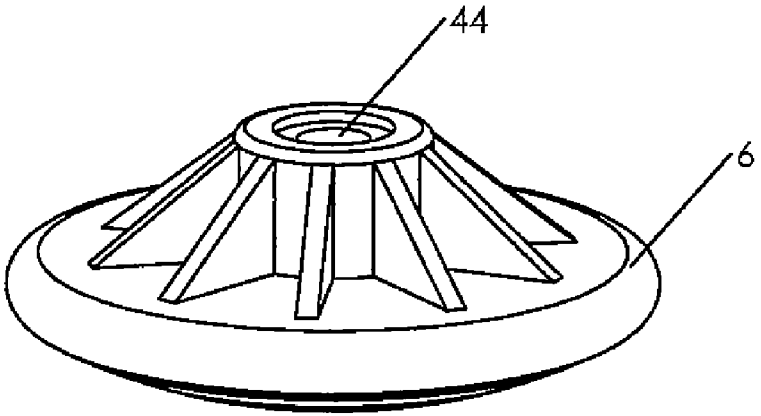
FIG. 13 is a top perspective view of the footpad of the present invention.
Figure 12:
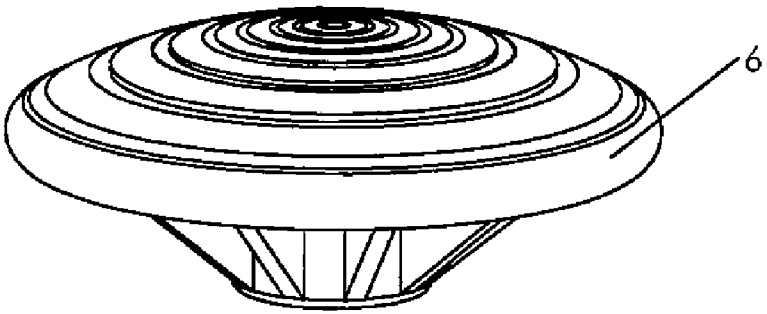
FIG. 12 is a bottom perspective view of the footpad of the present invention.

FIGS. 12 and 13 are bottom perspective and top perspective views, respectively, of the footpad of the present invention. In a preferred embodiment, the foot pad 6 is shaped as shown in FIGS. 12 and 13 with a relatively broad rounded underside. This shape allows the foot pad to rock in all directions, as necessary, to accommodate the movement of the patient and the horizontal swivel of the armpit pad 1. The top side of the foot pad 6 comprises a threaded recess 44 into which the piston 13 of the shock absorber 7 or the end piece 45 (see FIG. 18), whichever the case may be, is screwed.

In addition to affording the advantageous features described above, namely, the horizontally swiveling and vertically tilting armpit pad, the offset hand grip, the gas shock, the optimally shaped foot pad, and the three-part tubing, the present invention is also designed to accommodate accessories, such as clipboards and beverage holders, to make it even more convenient for the patient on crutches to function.

Figure 14:
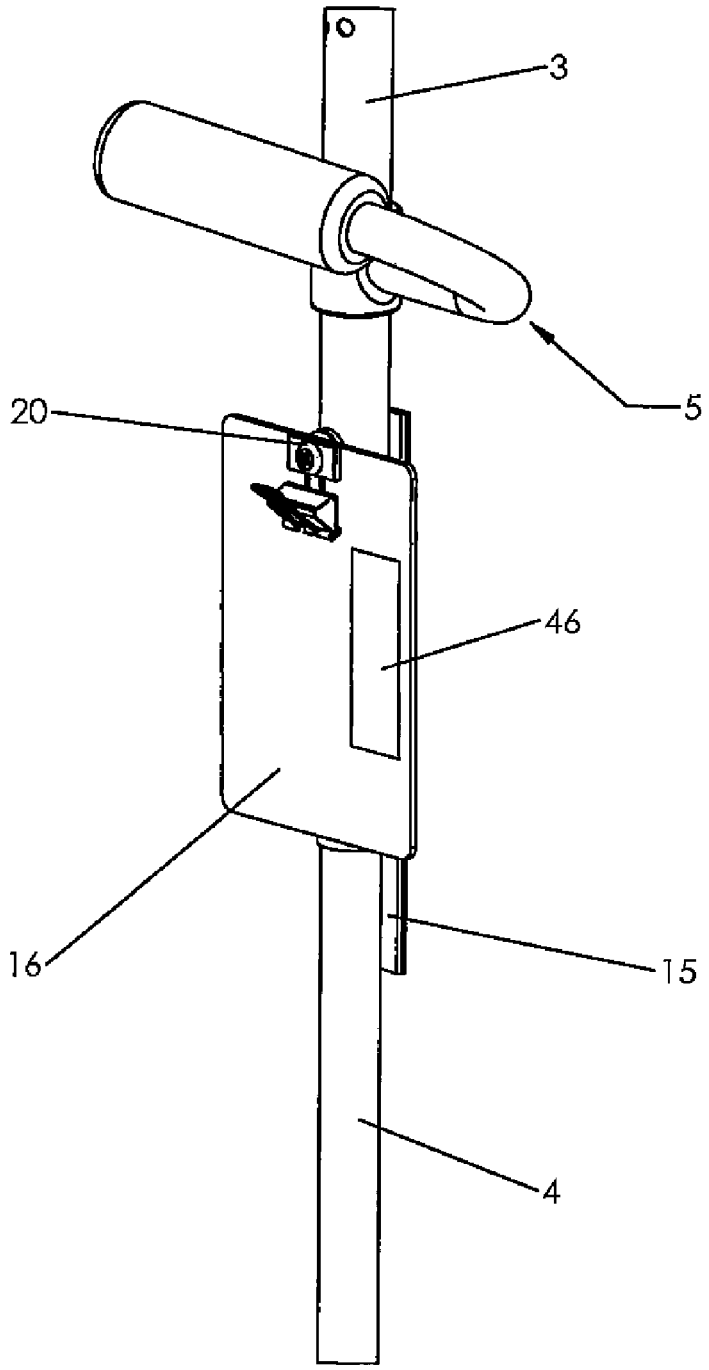
FIG. 14 is a partial perspective view of the present invention shown with an optional clipboard attachment.

FIG. 14 is a partial perspective view of the present invention shown with an optional clipboard attachment. The clipboard 16 is preferably attached to the middle tube 3 directly beneath the hand grip 5. The clipboard 16 is attached to the middle tube 3 with the same bolt 20 and nut 19 (or, in an alternate embodiment, rivet) that secure the rubber strap 15 to the middle tube 3. In a preferred embodiment the clipboard 16 comprises a magnetic strip 46 with which writing instruments or other metal objects can be held.

Figure 15:
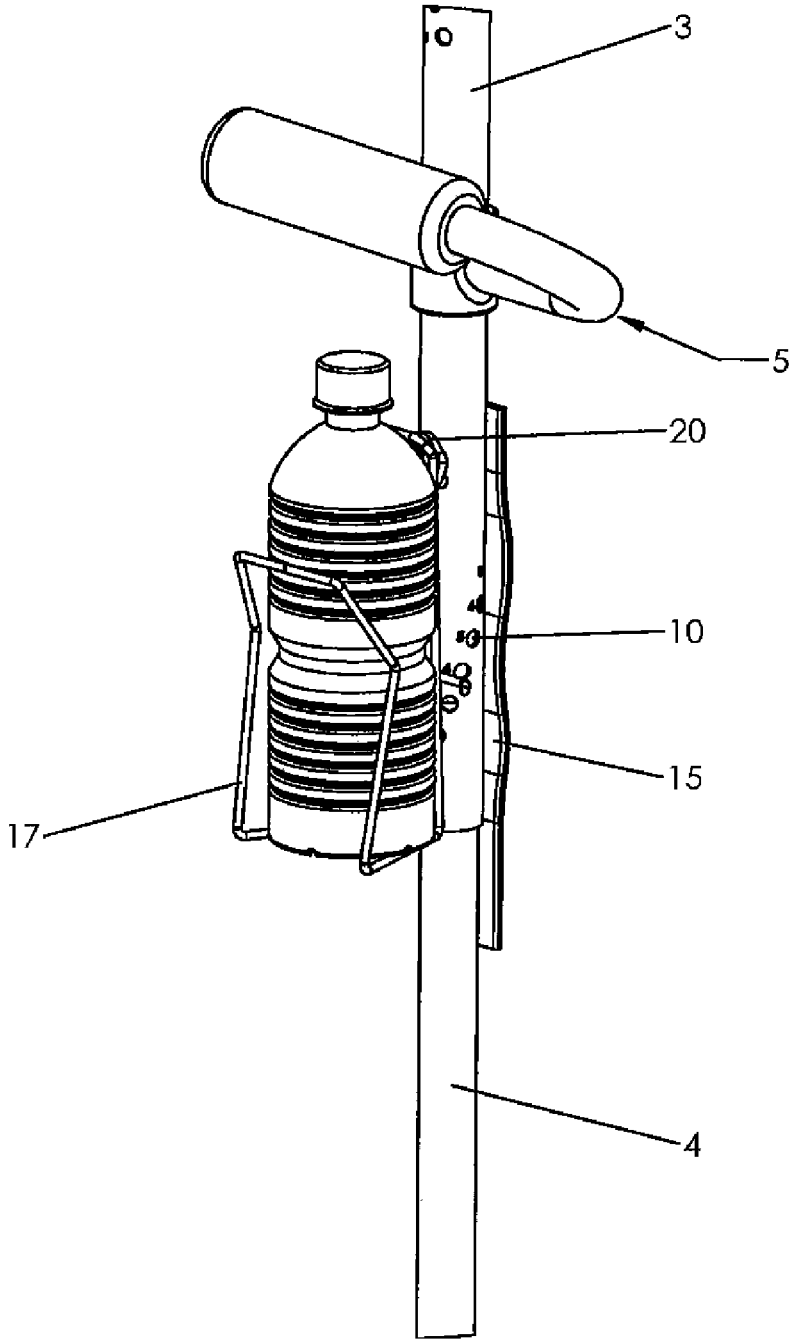
FIG. 15 is a partial perspective view of the present invention shown with an optional beverage holder attachment.

FIG. 15 is a partial perspective view of the present invention shown with an optional beverage holder attachment. The beverage holder 17 is preferably attached to the middle tube 3 directly beneath the hand grip 5. The beverage holder is attached to the middle tube 3 with the same bolt 20 and nut 21 (or, in an alternate embodiment, rivet) that secure the rubber strap 15 to the middle tube 3. The beverage holder 17 is preferably attached to the middle tube 3 at only this single point so that the beverage holder will rock from side to side when the crutch is in use, thereby maintaining the bottle in a constant vertical orientation relative to the ground.

FIG. 16 is a perspective view of a second embodiment of the present invention. This embodiment is identical to the first embodiment except that the crutch does not include a shock absorber (and, for that reason, the bottom tube 4 may be longer than it was in the first embodiment). This embodiment would provide a horizontally swiveling and vertically tilting armpit pad 1, but it would not eliminate the problem (described above) of the armpit pad 1 traveling in an arc-shaped path as opposed to a horizontal line when the crutch is in use. It may, however, be less expensive to manufacture than the first embodiment.

Figure 17:
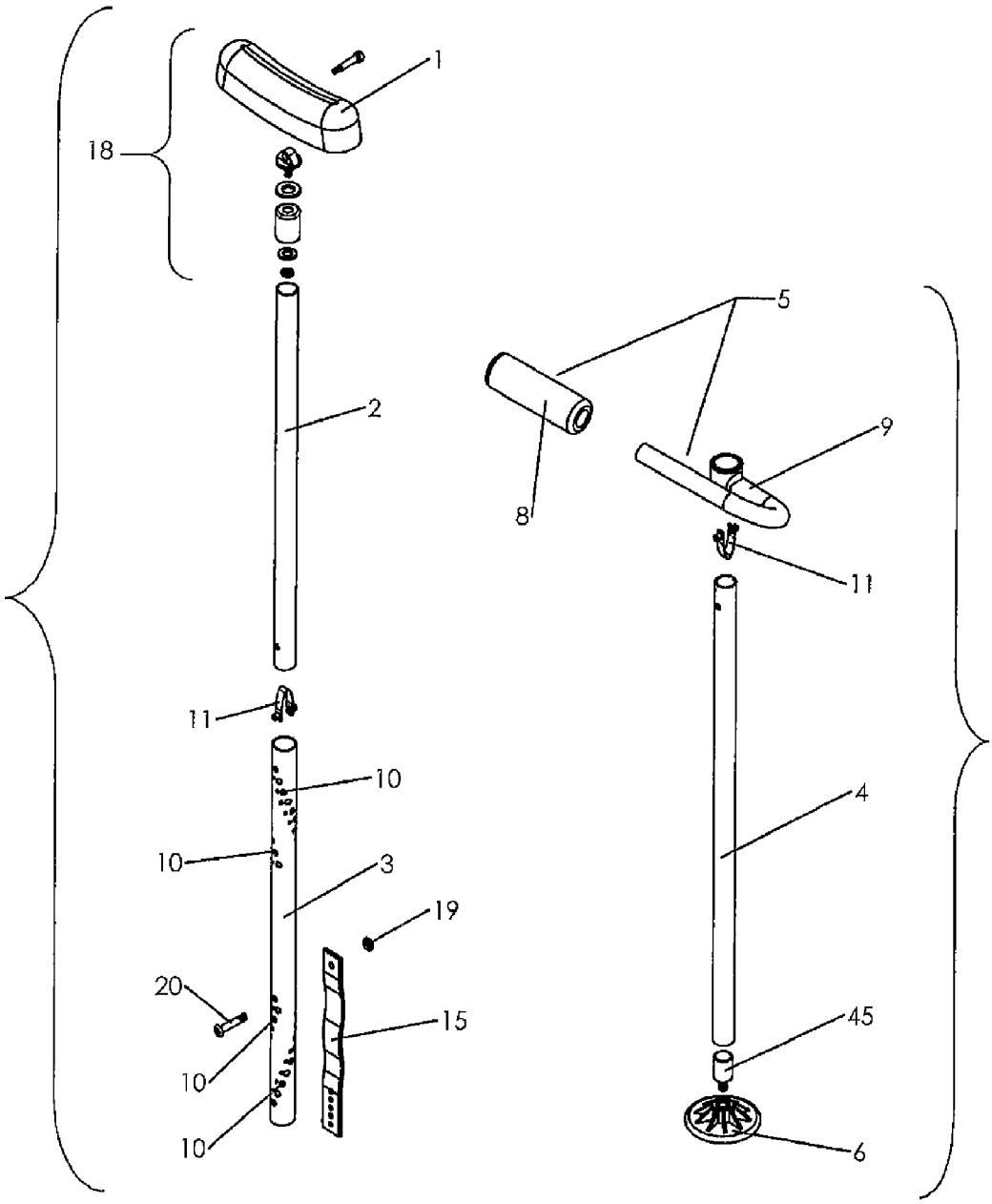
FIG. 17 is an exploded view of a second embodiment of the present invention.
Figure 18:
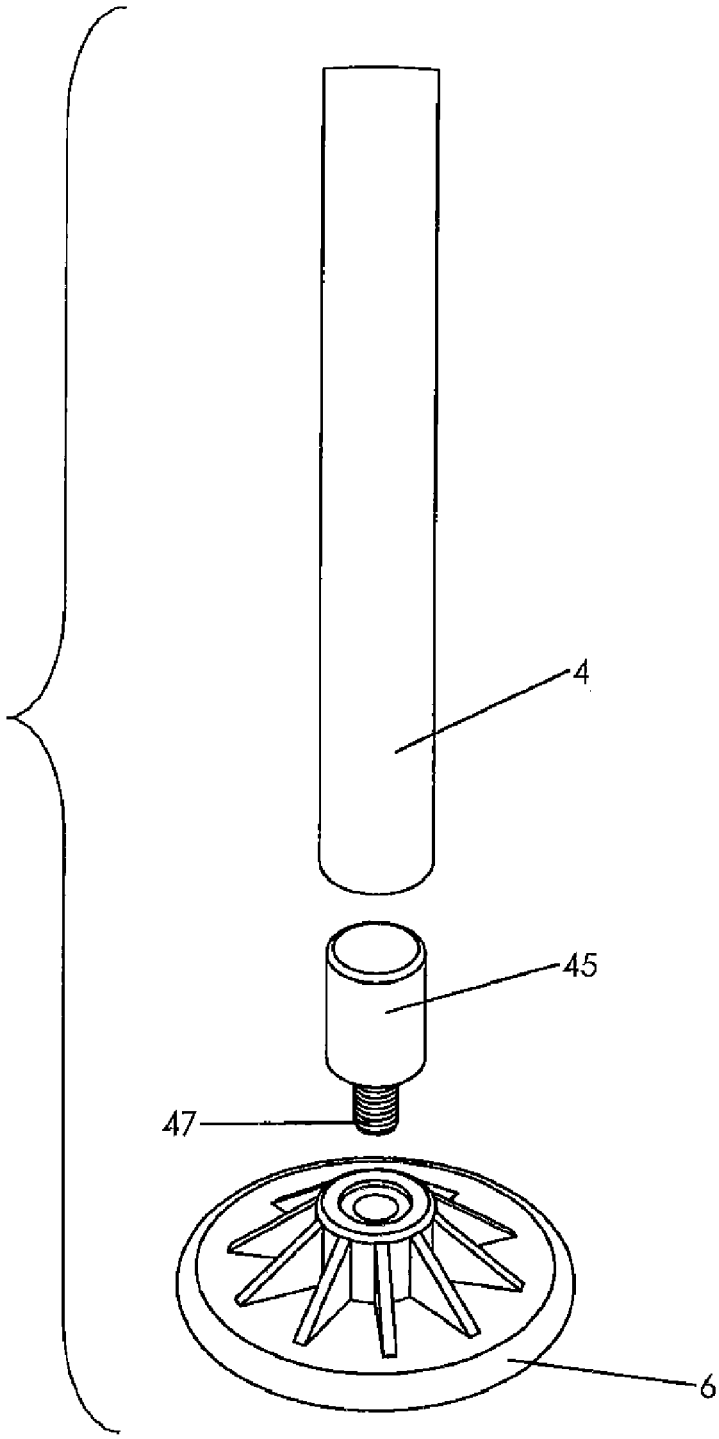
FIG. 18 is an exploded view of the footpad section of a second embodiment of the present invention.

FIG. 17 is an exploded view of a second embodiment of the present invention. This embodiment is identical to the first embodiment except for the foot pad assembly 21 (compare to FIG. 2). In this embodiment, because there is no shock absorber, the bottom tube 4 is longer than it is in the first embodiment (alternately, if the bottom tube is not longer, the end piece 45 would have to be longer), and it screws directly into the foot pad 6. As shown in FIG. 18, an end piece 45 with a threaded extension 47 is welded into the bottom end of the bottom tube 4 or inserted and held in place with a nut and bolt, and the threaded extension 47 screws into the recess 44 in the foot pad 6.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. An ergonomic crutch comprising:

(a) an armpit pad assembly;

(b) a top tube;

(c) a middle tube;

(d) a bottom tube;

(e) a hand grip;

(f) a shock absorber; and (g) a footpad assembly;

wherein the armpit pad assembly comprises an armpit pad and means for allowing the armpit pad to tilt vertically and swivel horizontally;

wherein the armpit pad having an underside comprises two angled walls and two shoulders;

wherein the means for allowing the armpit pad to tilt vertically and swivel horizontally is connected between the two shoulders and is located entirely within the two angled walls of the armpit pad;

wherein the top tube comprises a top end and a bottom end, and the armpit pad assembly connects to the top end of the top tube;

wherein the middle tube comprises a top end and a bottom end;

wherein the bottom end of the top tube slides into the top end of the middle tube;

wherein the bottom tube comprises a top end and a bottom end;

wherein the top end of the bottom tube slides into the bottom end of the middle tube;

wherein the hand grip is connected to and offset laterally from the middle tube;

wherein the shock absorber comprises a barrel and a piston;

wherein the barrel of the shock absorber is situated inside of the bottom end of the bottom tube, and the piston of the shock absorber protrudes downward from the bottom end of the bottom tube;

wherein the footpad assembly comprises a footpad;

wherein the piston of the shock absorber comprises a top end and a bottom end; and wherein the bottom end of the piston of the shock absorber connects to the footpad.

2. The erogonomic crutch of claim 1, wherein the top, middle and bottom tubes are approximately the same length.

3. The ergonomic crutch of claim 1, wherein the armpit pad is gel-filled.

4. The ergonomic crutch of claim 1, wherein the middle tube comprises a top half and a bottom half;

wherein the middle tube comprises four series of spirally aligned apertures, two of which are located in the top half of the middle tube, and two of which are located in the bottom half of the middle tube; and wherein the spirally aligned apertures are configured such that each aperture has a corresponding aperture exactly horizontal to it on an opposite side of the middle tube to facilitate securing the top and bottom tubes inside of the middle tube.

5. The ergonomic crutch of claim 1, wherein the hand grip comprises a cushioned pad and a metal bar;

wherein the middle tube comprises a middle;

wherein the metal bar is attached to the middle of the middle tube;

wherein the metal bar extends from the middle tube in a first direction, makes a U turn, and then extends in a second direction opposite to the first direction to a point beyond the middle tube, thereby forming a short arm and a long arm of the metal bar;

wherein the cushioned pad is wrapped around the long arm of the metal bar;

wherein the cushioned pad comprises a center;

wherein the foot pad comprises a center; and wherein the center of the cushioned pad is directly adjacent to the center of the foot pad from the perspective of a top view of the crutch.

6. The ergonomic crutch of claim 5, wherein the cushioned pad is gel-filled.

7. The ergonomic crutch of claim 5, further comprising a rubber strap;

wherein the rubber strap is used to secure the top, middle and bottom tubes together when the crutch is disassembled;

wherein the rubber strap comprises a first end and a second end;

wherein the first end of the rubber strap is attached to the middle tube at a point directly beneath the point at which the metal bar of the hand grip is attached to the middle of the middle tube;

wherein there is a side of the middle tube that faces the patient when the crutch is in use and a side of the middle tube that does not face the patient when the crutch is in use; and wherein the point at which the rubber strap is attached to the middle tube is on the side of the middle tube that faces the patient when the crutch is in use.

8. The ergonomic crutch of claim 7, further comprising a clipboard, wherein the clipboard attaches to the middle tube at a point on the middle tube directly opposite the point at which the rubber strap attaches to the middle tube.

9. The ergonomic crutch of claim 8, wherein the clipboard comprises a magnetic strip.

10. The ergonomic crutch of claim 7, further comprising a removable beverage holder, wherein he beverage holder comprises a top end and a bottom end;

wherein the top end of the beverage holder attaches to the middle tube at a point on the middle tube directly opposite the point at which the rubber strap attaches to the middle tube; and wherein the bottom end of the beverage holder is not attached to the middle tube so that it can swing freely and maintain a vertical orientation when the crutch is in use.

11. The ergonomic crutch of claim 1, wherein the crutch is used by a patient, and wherein the shock absorber is adjustable based on the weight of the patient.

12. The ergonomic crutch of claim 1, wherein the footpad comprises a broad rounded underside that allows the foot pad to rock in all directions.

13. The ergonomic crutch of claim 1, wherein the armpit pad assembly further comprises a primary swivel part, a first washer, a cap, a second washer, a nut, and a shoulder bolt;

wherein the primary swivel part is inserted into the underside of the armpit pad and secured with the shoulder bolt;

wherein the primary swivel part comprises a top section, a disc, a bottom extension, and a threaded portion;

wherein the shoulder bolt extends through an aperture in the top section of the primary swivel part;

wherein the cap comprises a top surface with an aperture and an underside;

wherein the first washer is positioned over the bottom extension of the primary swivel part and the bottom extension inserted into the aperture in the top surface of the cap;

wherein the second washer is inserted over the bottom extension of the primary swivel part underneath the aperture in the top surface of the cap;

wherein the nut is screwed onto the threaded portion of the primary swivel part to secure the primary swivel part on the cap;

wherein the cap is affixed to the top end of the top tube; and wherein the disc of the primary swivel part lies flat against the first washer, the first washer lies flat against the top surface of the cap, and the second washer lies flat against the underside of the top surface of the cap, thereby allowing the armpit pad to swivel horizontally in relation to the top tube.

14. The ergonomic crutch of claim 13, wherein the disc of the primary swivel part comprises a bottom surface;

wherein the primary swivel part comprises a bottom extension that extends downward from the bottom surface of the disc and connects to the threaded portion of the primary swivel part;

wherein the bottom extension has a height;

wherein the first washer, top surface of the cap, and second washer each has a thickness; and wherein the height of the bottom extension is slightly greater than the total thickness of the first washer, the top surface of the cap, and the second washer.

15. The ergonomic crutch of claim 13, wherein the top section of the primary swivel part fits in between the two shoulders of the underside of the armpit pad;

wherein the shoulder bolt extends through an aperture on one side of the armpit pad, through one of the two shoulders, through the aperture in the top section of the primary swivel part, and through the other shoulder; and wherein the shoulder bolt comprises a threaded portion that screws into a side wall of the armpit pad.

16. The ergonomic crutch of claim 15, wherein the angled walls of the armpit pad allow the armpit pad to tilt vertically when the armpit pad assembly is fully assembled;

wherein each angled wall has an angle, and the angle of one angled wall is equal to the angle of the other angled wall;

wherein the angle of the angled walls determines how far the armpit pad is capable of tilting vertically; and wherein the angle of the angled walls can be adjusted during manufacture to allow for greater or lesser tilt of the armpit pad.

17. An ergonomic crutch comprising:

(a) an armpit pad assembly;

(b) a top tube;

(c) a middle tube;

(d) a bottom tube;

(e) a hand grip; and (f) a footpad assembly;

wherein the armpit pad assembly comprises an armpit pad and means for allowing the armpit pad to tilt vertically and swivel horizontally;

wherein the armpit pad having an underside comprises two angled walls and two shoulders;

wherein the means for allowing the armpit pad to tilt vertically and swivel horizontally is connected between the two shoulders, and is located entirely within the two angled walls of the armpit pad;

wherein the top tube comprises a top end and a bottom end, and the armpit pad assembly connects to the top end of the top tube;

wherein the middle tube comprises a top end and a bottom end;

wherein the bottom end of the top tube slides into the top end of the middle tube;

wherein the bottom tube comprises a top end and a bottom end;

wherein the top end of the bottom tube slides into the bottom end of the middle tube; and wherein the hand grip is connected to and offset laterally from the middle tube.

18. The ergonomic crutch of claim 17, wherein the armpit pad is gel-filled.

19. The ergonomic crutch of claim 17, wherein the middle tube comprises a top half and a bottom half;

wherein the middle tube comprises four series of spirally aligned apertures, two of which are located in the top half of the middle tube, and two of which are located in the bottom half of the middle tube; and wherein the spirally aligned apertures are configured such that each aperture has a corresponding aperture exactly horizontal to it on an opposite side of the middle tube to facilitate securing the top and bottom tubes inside of the middle tube.

20. The ergonomic crutch of claim 17, wherein the hand grip comprises a cushioned pad and a metal bar;

wherein the middle tube comprises a middle;

wherein the metal bar is attached to the middle of the middle tube;

wherein the metal bar extends from the middle tube in a first direction, makes a U turn, and then extends in a second direction opposite to the first direction to a point beyond the middle tube, thereby forming a short arm and a long arm of the metal bar;

wherein the cushioned pad is wrapped around the long arm of the metal bar;

wherein the cushioned pad comprises a center;

wherein the foot pad comprises a center; and wherein the center of the cushioned pad is directly adjacent to the center of the foot pad from the perspective of a top view of the crutch.

21. The ergonomic crutch of claim 20, wherein the cushioned pad is gel-filled.

22. The ergonomic crutch of claim 20, further comprising a rubber strap;

wherein the rubber strap is used to secure the top, middle and bottom tubes together when the crutch is disassembled;

wherein the rubber strap comprises a first end and a second end;

wherein the first end of the rubber strap is attached to the middle tube at a point directly beneath the point at which the metal bar of the hand grip is attached to the middle of the middle tube;

wherein there is a side of the middle tube that faces the patient when the crutch is in use and a side of the middle tube that does not face the patient when the crutch is in use; and wherein the point at which the rubber strap is attached to the middle tube is on the side of the middle tube that faces the patient when the crutch is in use.

23. The ergonomic crutch of claim 22, further comprising a clipboard, wherein the clipboard attaches to the middle tube at a point on the middle tube directly opposite the point at which the rubber strap attaches to the middle tube.

24. The ergonomic crutch of claim 23, wherein the clipboard comprises a magnetic strip.

25. Tue ergonomic crutch of claim 22, further comprising a removable beverage holder, wherein the beverage holder comprises a top end and a bottom end;

wherein the top end of the beverage holder attaches to the middle tube at a point on the middle tube directly opposite the point at which the rubber strap attaches to the middle tube; and wherein the bottom end of the beverage holder is not attached to the middle tube so that it can swing freely and maintain a vertical orientation when the crutch is in use.

26. The ergonomic crutch of claim 17, wherein the footpad assembly comprises a footpad with a broad rounded underside that allows the footpad to rock in all directions.

27. The ergonomic crutch of claim 17, wherein the armpit pad assembly further comprises a primary swivel part, a first washer, a cap, a second washer, a nut, and a shoulder bolt;

wherein the primary swivel part is inserted into the underside of the armpit pad and secured with the shoulder bolt;

wherein the primary swivel part comprises a top section, a disc, a bottom extension, and a threaded portion;

wherein the shoulder bolt extends through an aperture in the top section of the primary swivel part;

wherein the cap comprises a top surface with an aperture and an underside;

wherein the first washer is positioned over the bottom extension of the primary swivel part and the bottom extension inserted into the aperture in the top surface of the cap;

wherein the second washer is inserted over the bottom extension of the primary swivel part underneath the aperture in the top surface of the cap;

wherein the nut is screwed onto the threaded portion of the primary swivel part to secure the primary swivel part on the cap;

wherein the cap is affixed to the top end of the top tube; and wherein the disc of the primary swivel part lies flat against the first washer, the first washer lies flat against the top surface of the cap, and the second washer lies flat against the underside of the top surface of the cap, thereby allowing the armpit pad to swivel horizontally in relation to the top tube.

28. The ergonomic crutch of claim 27, wherein the disc of the primary swivel part comprises a bottom surface;

wherein the primary swivel part comprises a bottom extension that extends downward from the bottom surface of the disc and connects to the threaded portion of the primary swivel part;

wherein the bottom extension has a height;

wherein the first washer, top surface of the cap, and second washer each has a thickness; and wherein the height of the bottom extension is slightly greater than the total thickness of the first washer, the top surface of the cap, and the second washer.

29. The ergonomic crutch of claim 27, wherein the top section of the primary swivel part fits in between the two shoulders of the underside of armpit pad;

wherein the shoulder bolt extends through an aperture on one side of the armpit pad, through one of the two shoulders, through the aperture in the top section of the primary swivel part, and through the other shoulder; and wherein the shoulder bolt comprises a threaded portion that screws into a side wall of the armpit pad.

30. The ergonomic crutch of claim 29, wherein the angled walls of the armpit pad allow the armpit pad to tilt vertically when the armpit pad assembly is fully assembled;

wherein each angled wall has an angle, and the angle of one angled wall is equal to the angle of the other angled wall;

wherein the angle of the angled walls determines how far the armpit pad is capable of tilting vertically; and wherein the angle of the angled walls can be adjusted during manufacture to allow for greater or lesser tilt of the armpit pad.

* * * * *